United States Patent [19]

Askman

[11] 4,117,326

[45] Sep. 26, 1978

[54] ION GENERATOR

[75] Inventor: Jan Philip Askman, Carlisle, Pa.

[73] Assignee: AMP Incorporated, Harrisburg, Pa.

[21] Appl. No.: 818,909

[22] Filed: Jul. 25, 1977

[51] Int. Cl.[2] ..... H01T 19/04

[52] U.S. Cl. ..... 250/324; 250/432 R

[58] Field of Search ..... 250/435, 432 R, 324–326, 250/426, 427

[56] References Cited

U.S. PATENT DOCUMENTS

| | | | |
|---|---|---|---|
| 2,576,399 | 11/1951 | Hicks | 250/432 R |
| 2,928,942 | 3/1960 | Hicks et al. | 250/435 |
| 3,691,373 | 12/1972 | Compton | 250/324 |
| 3,900,735 | 8/1975 | Jahn | 250/324 |

*Primary Examiner*—Harold A. Dixon

*Attorney, Agent, or Firm*—Russell J. Egan

[57] ABSTRACT

An ion gun is disclosed for creating an ionized environment within an enclosure. A plurality of like ion guns are connected in series with a high voltage source and continuously generate ions, when the energy source is activated.

5 Claims, 2 Drawing Figures

ION GENERATOR

BACKGROUND OF THE INVENTION

1. The Field Of The Invention

The present invention relates to an ion gun for generating an ion stream into the atmosphere.

2. The Prior Art

It has long been established that there are certain beneficial effects to be achieved in the area of livestock husbandry in having the atmosphere surrounding the animals slightly ionized or negatively charged by electricity. This charging of the atmosphere produces a tranquilizing effect calming nervous animals, such as race horses, and improving the production of animals, such as chickens and dairy cattle.

The normal air borne particles carry both positive and negative charges. When the positive-negative balance is changed, the behavior of these particles also changes. Positively charged particles tend to bounce off each other, walls, floors, etc., and remain air borne while negatively charged particles tend to collect and settle out of the air. Thus if dust, smoke, and odor carrying particles can be negatively charged, they can be readily cleared from the air. This effect has been often verified, for example, see the article *Biological Impact Of Small Air Ions* by Albert Paul Drueger and Eddie James Reed appearing in the American Association for the Advancement of Science 24 September, 1976, Volume 193, pp. 1209–1213.

Similar beneficial effects can be achieved in human environments. In the book *The Ion Effect* (E. P. Dutton 1977) Fred Soyka explains that the air we breath contains large numbers of unstable molecules or ions. The balance of these ions can be upset by natural and man-made phenomena with a corresponding noticeable change in human behavior. Creation of a negative ion balance has noticeable beneficial effects.

SUMMARY OF THE INVENTION

The present invention is used in series with a high voltage source and includes a substantially T-shaped housing having first and second contact receiving apertures in the opposite ends of the cross bar portion, a pin contact extending between and into said apertures, a recess in the leg portion, and a resistance element in said leg recess electrically and mechanically connecting said pin, whereby electrons leak from the resistance element into the atmosphere upon energization of the high voltage line.

It is an object of the present invention to produce an improved ion generator to create a negative ion balance within a specific area.

It is also an object of the present invention to produce an ion generator, a plurality of which are connected in series with a high voltage source, for generating a constant supply of negative ions which will restore a favorable ion balance to the surrounding atmosphere while ridding the atmosphere of unwanted dust and odor carrying particles.

It is a further object of the present invention to produce an ion generator which improves the ion balance of the immediate atmosphere thereby making it more habitable to humans and animals.

It is a further object of the present invention to produce an ion gun which can be readily and economically manufactured.

The means for accomplishing the foregoing objects and other advantages of the present invention will become apparent to those skilled in the art from the following detailed description taken with reference to the accompanying drawings.

DETAILED DESCRIPTION OF THE PRESENT INVENTION

Figure 1:
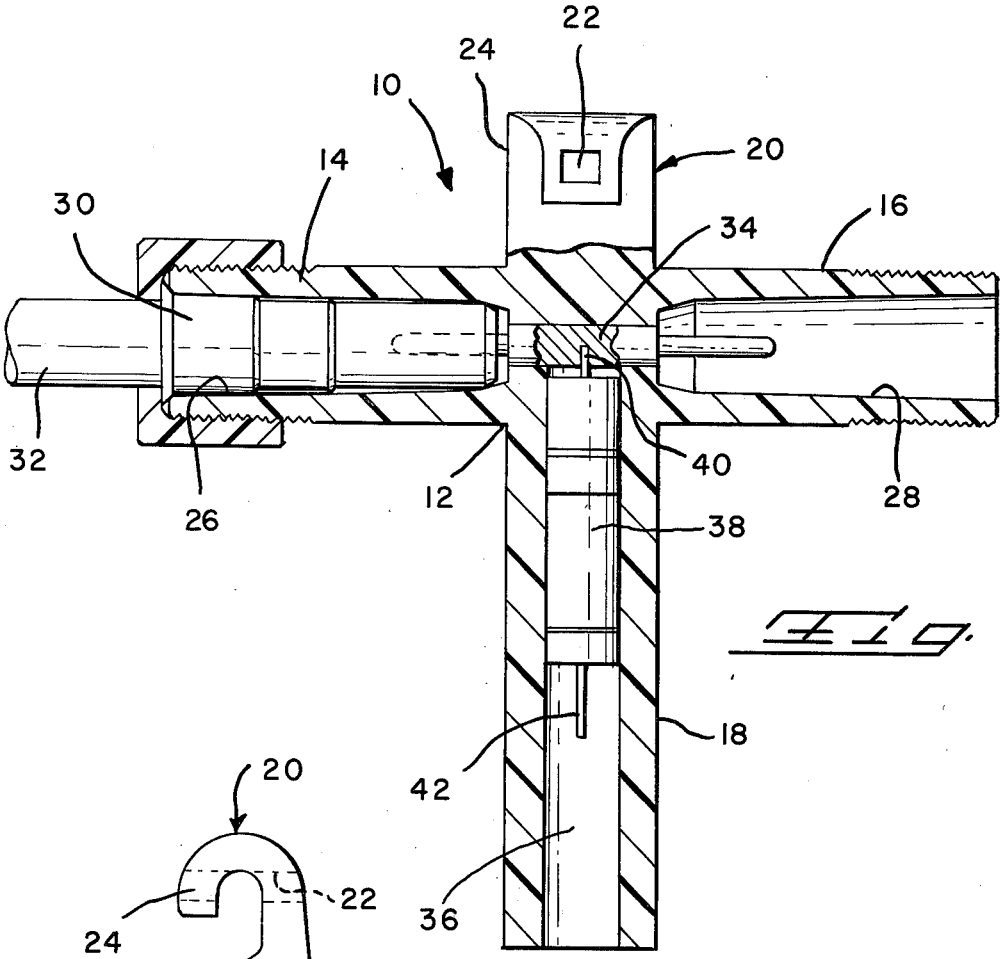
FIG. 1 is a plan view, partially in section, showing the subject ion gun.
Figure 2:
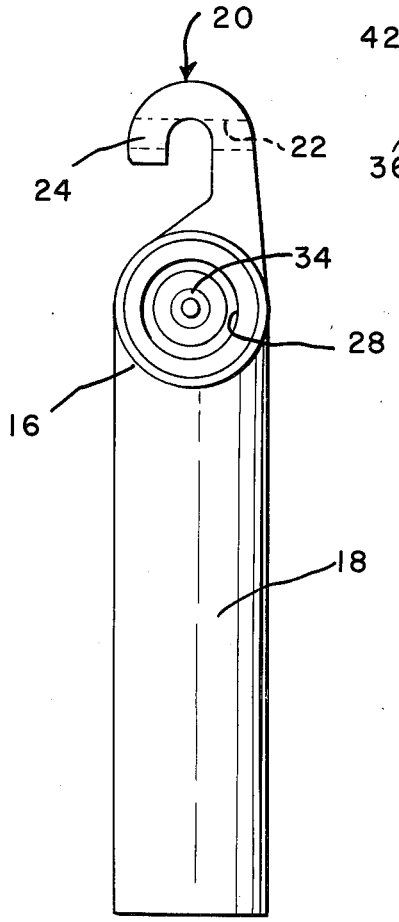
FIG. 2 is a side elevation of the subject ion gun.

The subject ion gun 10 has a substantially T-shaped housing 12 having a cross bar 14, 16 and a central depending leg portion 18. The cross bar portion 14, 16 includes a flange 20 having an aperture 22 and at least one hook 24 for mounting the gun either against a solid member, by means of a nail or screw (not shown) or suspended over a member, such as a wire or rod (also not shown). At opposite ends of the cross bar portions 14, 16 are recesses 26, 28 which are profiled to receive electrical connectors 30 terminating an electrical cable 32. A fixed pin contact 34 interconnects the recesses 26, 28 and is adapted to engage the electrical connector 30. The connector 30 is shown having a threaded cap which engages like threads on the cross bar portions. This provides assurance that there will not be an accidental unmating of the contact. The leg portion 18 has a recess 36 which receives therein a *resistive element* 38 making electrical and mechanical contact with the pin contact 34 by lead 40 while lead 42 is clipped closely adjacent the resistive element to lie totally within recess 36.

It is intended that the subject ion gun be insert molded in a single shot process with the contact 34 in place. The material used for the housing can be selected from any of the well known plastics that have good electrical insulating characteristics.

In operation, a plurality of the subject ion guns would be mounted about the periphery of a barn, stable, or the like and connected in series to a power source by electrical cables. The cables would then be charged with high voltage, on the order of 20 kilovolts, and a constant source of ions would be generated from leakage of electricity out of the resistive element, which would be a 200 magaohm resistor in this case.

The resistive element 38 also acts as a safety device in that it limits the voltage as the current increases.

The present invention may be subject to modifications and changes without departing from the spirit or essential characteristics of the invention. The present embodiment is therefore to be considered in all respects as illustrative and not restrictive of the scope of the invention.

What is claimed is:

1. An ion generator comprising a substantially T-shaped housing having a pair of cross bar portions and a centrally depending leg portion, each said cross arm portion and said leg portion of said housing having a recess therein, a fixed pin contact interconnecting said recesses in said cross arm portions and adapted to engage electrical connectors inserted therein, a resistive element inserted into said recess of said leg portion electrically and mechanically engaging said pin, and means to fixedly mount said housing.

2. An ion generator according to claim 1 wherein said housing is made of an insulative material.

3. An ion generator according to claim 1 wherein each end of said cross arm is profiled to securely receive said electrical connector therein.

4. An ion generator according to claim 1 wherein said means to fixedly mount said housing comprises an integral hook.

5. A method for controlling the ion balance in an enclosed atmosphere comprising:

connecting a plurality of ion guns in series with a high voltage source, each said ion gun having a T-shaped configuration with connecting means in the cross bar portion, a resistive element in the depending leg, and conductive means connecting the connecting means to said resistive element, and applying at least 10 kilovolts to said ion guns whereby a constant supply of negative ions is discharged into the environment to achieve a favorable negative to positive ion balance.

* * * * *